US005158140A

United States Patent [19]

Ferry

[11] Patent Number: 5,158,140

[45] Date of Patent: Oct. 27, 1992

[54] APPARATUS AND METHOD FOR CLEANING OUT AN UNDERGROUND WELL

[75] Inventor: Jean-Claude Ferry, Arthez de Bearn, France

[73] Assignee: Societe Nationale Elf Aquitaine (Production), France

[21] Appl. No.: 768,435

[22] PCT Filed: Dec. 10, 1990

[86] PCT No.: PCT/FR90/00895

§ 371 Date: Sep. 26, 1991

§ 102(e) Date: Sep. 26, 1991

[87] PCT Pub. No.: WO91/09205

PCT Pub. Date: Jun. 27, 1991

[30] Foreign Application Priority Data

Dec. 11, 1989 [FR] France ..... 89 16346

[51] Int. Cl.[5] ..... E21B 37/00

[52] U.S. Cl. ..... 166/312; 166/105; 175/65

[58] Field of Search ..... 166/312, 311, 223, 106, 166/68

[56] References Cited

U.S. PATENT DOCUMENTS

| | | | |
|---|---|---|---|
| 3,020,955 | 2/1962 | Tausch . | |
| 3,279,543 | 10/1966 | Yetman | 166/312 |
| 3,791,447 | 2/1974 | Smith et al. | 166/311 |
| 4,171,016 | 10/1979 | Kempton . | |
| 4,671,359 | 6/1987 | Renfro | 166/312 |
| 4,744,420 | 5/1988 | Patterson et al. | 166/312 |
| 4,799,554 | 1/1989 | Clapp et al. | 166/312 |
| 4,921,577 | 5/1990 | Eubank | 166/311 |
| 5,033,545 | 7/1991 | Sudol | 166/312 |

*Primary Examiner*—Ramon S. Britts
*Assistant Examiner*—Frank S. Tsay
*Attorney, Agent, or Firm*—Bacon & Thomas

[57] ABSTRACT

Method has been provided for cleaning a vertical, deviated or horizontal underground well. In which a maintenance tubing having a cleaning head at its end is lowered into a production pipe for suction of sediments. At a certain level above the region of the well to be cleaned, a hydraulic isolation device is installed in the annulus between the maintenance tubing and the production pipe. Fluid is injected into the annulus to activate the hydroejector which is located above the hydraulic isolation device to cause the suction of the sediments. The sediments downhole therefore can be cleaned out without introducing foreign fluid downhole.

13 Claims, 2 Drawing Sheets

APPARATUS AND METHOD FOR CLEANING OUT AN UNDERGROUND WELL

BACKGROUND OF THE INVENTION

The present invention relates to a method of cleaning out an underground well and to an apparatus for applying said method.

When well bottom deposits, particularly sandy sediments of unconsolidated formations, are present, a first method consists in using drilling apparatus to recondition the production tubing at stratum level. The application of this method is very onerous because the equipment installed has to be dismantled and a new completion is necessary after the cleaning operation. In order to avoid having to resort to such heavy "workover" operations, various means are available for the concentric maintenance of well bottoms.

In particular, from U.S. Pat. No. 4,671,359 a cleanout system is known for extracting sediments from a lost casing (with or without integrated gravel packing), this system requiring a rigid tubular extension lowered by cable and anchored in a suitable receptacle to the bottom of the production tubing. A continuous flexible tube known as "coiled tubing" is lowered through this extension, carrying at its end nozzles distributing cleaning fluid which is supplied from the surface and the flow of which is directed towards the wall of the well bottom. The sediment is entrained in the stream of fluid pumped to the surface through the flexible tube, or more precisely the sediment rises to the surface through the annular space between the coiled tubing and the production tubing.

In a system of this kind the addition of this tubular extension to the production tubing and the use of the coiled tubing technique comprising a continuous flexible tube bring about an increase in the speed of the fluid and thus improve the evacuation of sediment via the annular space between the coiled tubing and said extension.

Nevertheless, this system has disadvantages.

A first disadvantage consists in that the circulation of the cleaning fluid exerts a back-pressure on the stratum, which is often friable and very sensitive (loss, emulsion, precipitate, etc.)

A second disadvantage consists in that the method requires a preliminary cable operation, the limitations of which in respect of length, load and deviation are well known.

A third disadvantage relates to formations under subhydrostatic conditions or depleted formations; through the back-pressure which it develops the system makes it necessary to use prepared fluids of low relative density which are compatible with the formation; this may then become prohibitive.

The extensive development of deviated and highly deviated wells and horizontal drains poses numerous new problems in connection with cleaning through the simple fact that the direction and speed of flow of the fluid evacuating solid matter by known, conventional methods and apparatus cannot oppose the forces tending to disintegrate the stratum.

From U.S. Pat. No. 4,744,420 an apparatus is thus also known for removing solid accumulations, such as sandy or other aggregates, from highly deviated or horizontal underground wells. This apparatus comprises a train of concentric tubes intended to be inserted into the well, one of said tubes being used to supply the working fluid to the well bottom and the other for returning the fluid loaded with sediment. At the end of the train the apparatus is also provided with a hydroejector which projects a part of the working fluid onto the sediment before applying suction to it.

Apart from the disadvantages already mentioned, the tube train is injected into the well after the existing completion has been dismantled. In addition, the apparatus cannot work continuously on a large area of accumulated sediment without extensive intervention, such as the addition of extra concentric tubes.

The use of this method disturbs the completion, and this is a major disadvantage.

SUMMARY OF THE INVENTION

In order to obviate these disadvantages the present invention provides a cleanout method according to which a small diameter maintenance tubing, known as "coiled tubing", is lowered into the production tubing, carrying at its end a cleanout head for extraction by suction of the sediment; at a certain level above the part of the well which is to be cleaned out a hydraulic separation is made in the annular space between the maintenance tubing and the production tubing, said maintenance tubing being axially slidable in said hydraulic separation over a length at least equal to the total length of the part of the well which is to be cleaned out; and into said annular space a working fluid is injected for the operation of a hydroejector which applies suction to the sediment to extract the latter through the maintenance tubing, said hydraulic separation isolating the pressurised annular space from the well bottom under reduced pressure.

According to this method, therefore, suction is applied to the sediment, and this suction thus eliminates all the disadvantages due to the pressure exerted on the stratum by the returning fluid charged with sediment.

Furthermore, as the hydraulic separation isolates the well bottom, the working fluid need not be compatible with it.

According to a preferred embodiment of the invention this hydraulic separation is effected with the aid of a stuffing box mounted on the maintenance tubing for sliding when the apparatus is in the cleaning position, said stuffing box cooperating with a landing nipple on the production tubing in order to make a sealing, sliding separation.

An arrangement of this kind constitutes a considerable advantage over the prior art, because the application of the method according to the invention does not disturb the existing completion. It is in fact only necessary for the existing completion to have a landing nipple towards the base of the production tubing for the positioning of the hydraulic separation.

According to another likewise preferred embodiment of the invention the maintenance tubing is a so-called "coiled tubing" of a diameter smaller than or equal to 38 mm. The coiled tubing is flexible, and by this means the method can be applied without discrimination to vertical wells, deviated wells, highly deviated wells, or horizontal drains. The coiled tubing is remarkable in that it makes perfect contact with the bottom generatrix of a highly deviated or horizontal drain.

The stuffing box preferably comprises a series of seals on its inside diameter in order to permit sealing sliding of the maintenance tubing on said stuffing box.

The stuffing box is shaped to bear against a shoulder on the landing nipple, and also comprises outside seals applied against the inside surface of said landing nipple. It is held in this position by the elevated pressure during operation.

The cleanout is then effected in one or more progressive passes by moving the cleanout head in the part of the well which is to be cleaned out, by sliding the maintenance tubing through the hydraulic separation, that is to say by sliding the tubing through the stuffing box.

The cleaning apparatus comprises a cleanout head mounted on the end of an extension of the maintenance tubing, a stuffing box mounted for sliding on said extension above said cleanout head, and a hydroejector mounted at the other end of said extension, the outlet of the hydroejector being connected to the surface by the maintenance tubing.

The cleanout head has an outside diameter smaller than the inside passage diameter of the landing nipple, while the stuffing box has an outside diameter larger than the inside passage diameter of the landing nipple, so as to be locked in respect of translation on said landing nipple.

On its insertion into the well, the stuffing box is provisionally locked in respect of translation on the cleanout head by means of a pin or any other equivalent means, which can be broken by elevated hydraulic pressure or a mechanical support on arrival in the landing nipple.

The cleanout head comprises an ejectable stopper closing the external fluid admission to the maintenance tubing, the ejection of the stopper being brought about by elevated pressure in the maintenance tubing.

The utilisation of an intervention technique which is well known and widely used, such as the coiled tubing technique, is a considerable advantage. The present invention does not relate to that technique in itself, it being known that said technique requires surface apparatus, known per se, such as a blow-out preventer (B.O.P.), a lock chamber, a coiled tubing storage drum, an injector and pumping means, all of which will not be described in detail and will not be illustrated within the framework of the present patent application.

It is also another object of the present invention to provide method of cleaning out which comprises the complete lowering of the maintenance tubing, according to which:

the extension—together with the cleanout head mounted at its end—is inserted under the packer or stripper of the coiled tubing, the stuffing box being fastened to the cleanout head;

the extension is suspended in the blow-out preventer and the jaws are closed around the tubing;

the lock chamber is opened;

the coiled tubing is cut;

the hydroejector is inserted with the aid of rapid action connectors;

the lock chamber is closed;

the jaws of the blow-out preventer are opened;

the lowering of the coiled tubing is continued until the stuffing box is engaged in the landing nipple fastened to the production tubing, the securing pin being sheared through;

the stopper is ejected from the head by elevated pressure in the maintenance tubing;

the working fluid is injected into the annular space between the production tubing and the coiled tubing (and therefore above the hydraulic separation) in order to start up the hydroejector;

the progressive lowering of the cleanout head is continued while observing the return of sediment to the surface.

BRIEF DESCRIPTION OF THE DRAWING

Other advantages and features of the present invention will emerge from the description given below of one non-limitative example of embodiment of the invention and accompanied by the drawings, in which:

FIG. 4*a* shows an exemplary embodiment of the outer face of said cleanout head, which is adapted to be rotated by the fluid drawn in.

DESCRIPTION OF THE PREFERRED EMBODIMENT

Figure 1:
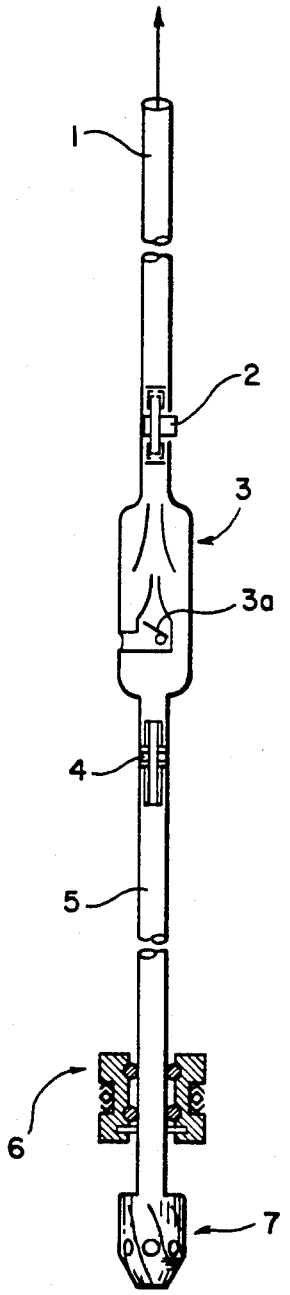
FIG. 1 shows the apparatus for cleaning out a well bottom being lowered into the well.

In FIG. 1 of the drawings the reference 1 designates a continuous tube of relatively small diameter, which is smaller than or equal to 38 mm (1½ inch). This tube is the tubing of a tool used for inter-vention operations under pressure in production wells, which is known as the "coiled tubing" technique, which is a technique in which a continuous flexible tube stored on a drum is injected into a well under pressure. This technique is suitable for any configuration of well head and allows speedy operation. The injection system, comprising in particular the blow-out preventer and the lock chamber, and also the coiled tubing storage system and the fluid injection means and means for pumping to the surface, are not shown in the drawings.

At the end of the coiled tubing 1 a venturi action pump or hydroejector 3 working with reversed pumping is mounted with the aid of a 38 mm (1½ inch) connector 2. A nonreturn valve 3*a* installed in the venturi prevents any return of liquid to the space surrounding the pump, as will be explained later on.

By means of an obturator connector given the reference 4, which has a diameter of 38 mm (1½ inch), the pump 3 is connected to a tubular extension 5, whose diameter is equal to that of the tubing 1 and whose length is adjustable in dependence on the dimensional characteristics of the well which is to be cleaned out. This length is at least equal to the distance between the selected hydraulic separation level (L in FIG. 2 of the drawing) and the most distant part of the well which is to be cleaned out.

A stuffing box 6 is mounted for sliding along the tubular extension 5. It is shown in greater detail in FIG. 3 of the drawings. On its inside bore 6*a* it has a series of lipped O-ring seals 6*b* and on its outside bore 6*c* a series of resilient, compressible lipped seals 6*d*, the seals 6*b* providing sealing on the tubular extension 5, while the outside seals 6*d* cooperate with a member on the production tubing (the landing nipple) to provide the hydraulic separation, as will be seen further on.

In the lowering position shown in FIG. 1 of the drawings the stuffing box 6 is locked in respect of translation on the top of a cleanout head 7 by means of a pin 8 (see FIG. 3), which can be sheared through under the conditions described later on in order to enable the maintenance tubing to slide in the inside bore of the stuffing box 6.

The end of the extension 5 is provisionally closed by an ejectable stopper 7a (see FIG. 4), which in its closed position serves to permit the connection of the pump 3 at the surface.

The cleanout head 7 extending the tubular extension 5 is designed to facilitate cleaning out by induced rotation and turbulence.

Figure 4:
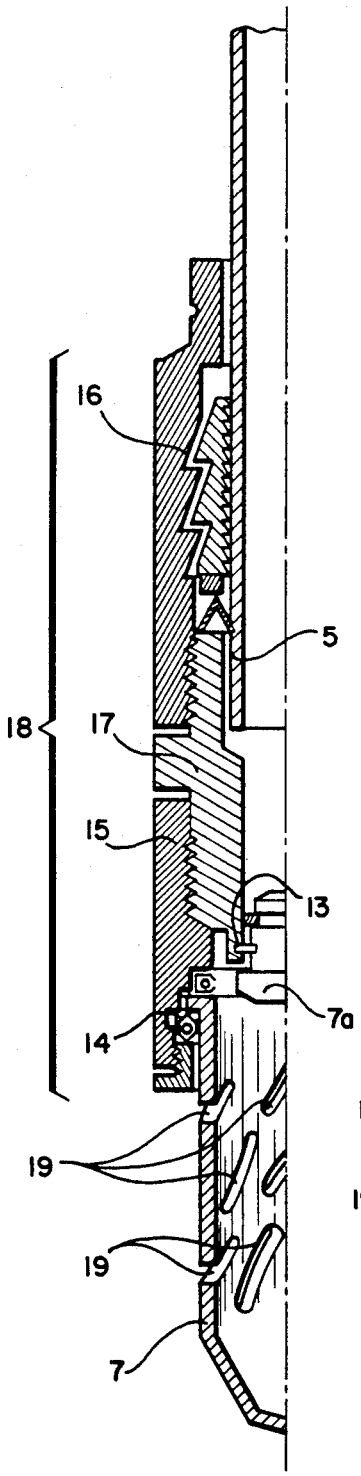
FIG. 4 shows an exemplary embodiment of the cleanout head, with its ejectable stopper.

In FIG. 4 of the drawings the cleanout head 7 and its mounting at the end of the tubular extension 5 are shown. The ejectable stopper 7a is locked in the closed position by means of the pin 13. The head is mounted rotatably in a ball bearing 14. A conventional grip connector 18 comprising the members 15, 16, 17 enables the head 7 to be fastened onto the extension 5.

Figure 4A:
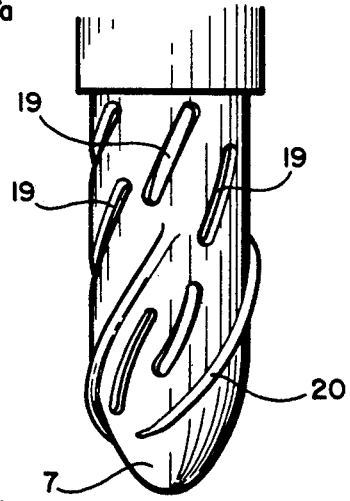

Oblong slots 19, pierced in non-radial directions but directed helically or quasi-helically, are provided in the head in order to impart to the cleanout head 7 a rotary movement through the action of the fluids passing through (FIG. 4a).

Turbulence fins 20 (FIG. 4a) may also be provided on the outer surface.

Figure 2:
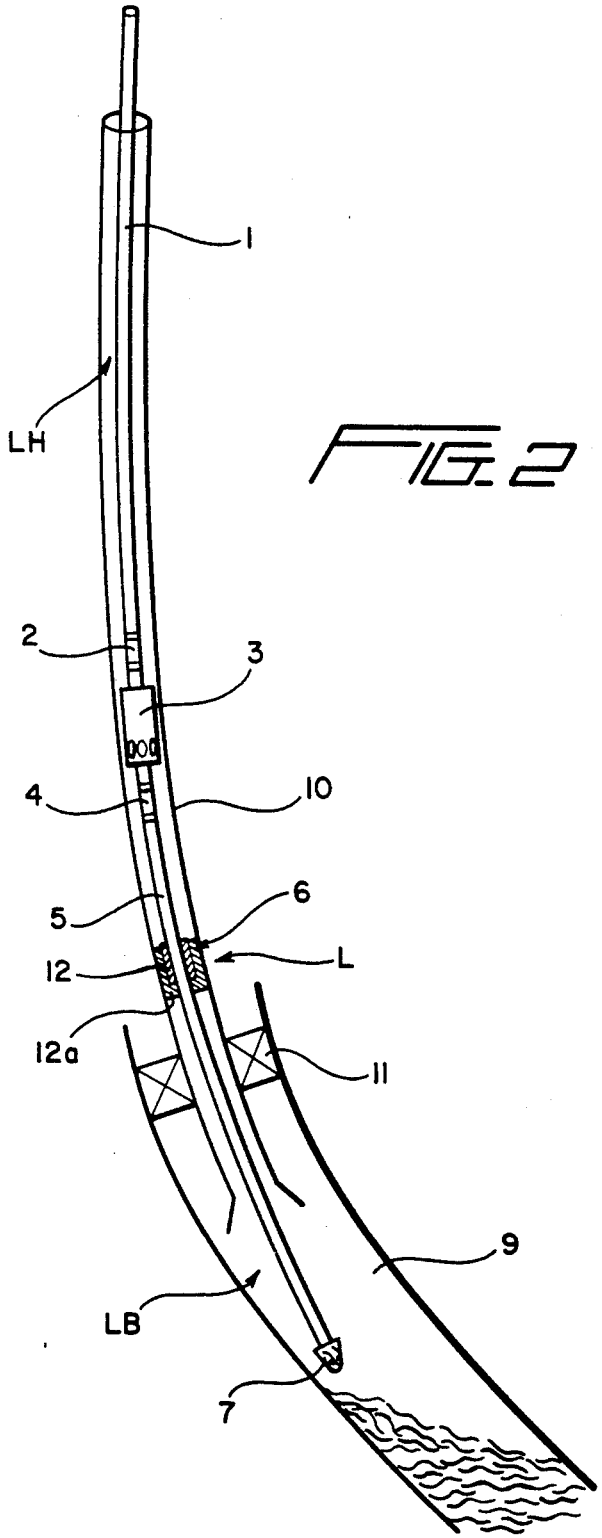
FIG. 2 shows the same apparatus in the cleanout position in the well.

In FIG. 2 of the drawings the reference 9 represents schematically the casing of the well, which may be a vertical well, a deviated or even highly deviated well, or even a horizontal drain. The production tubing is designated 10. The annular space between the production tubing 10 and the casing 9 is closed by a packer 11 The cleanout unit or maintenance tubing shown in FIG. 1 is introduced into the production tubing 10, which has a well bottom landing nipple 12 which by its shoulder 12a forms a seat for the stuffing box 6. In the example now being described the production tubing 10 may be of any diameter.

Figure 3:
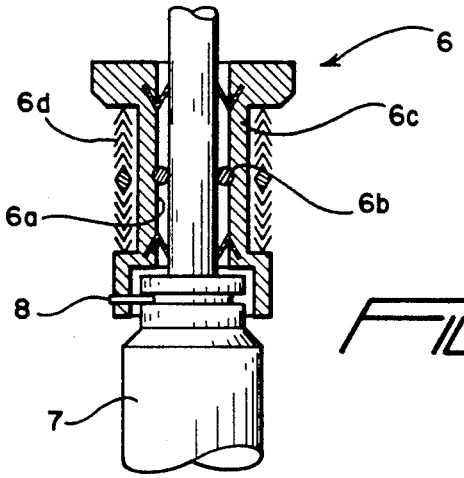
FIG. 3 shows the stuffing box of the apparatus shown in FIGS. 1 and 2.

The cleanout system operates as follows:

The cooled tubing wound on a drum at the surface is inserted, without disturbing the pressure prevailing at the well head, into a packer-stripper (not shown) with the addition of lubricating grease, and carries the cleanout head 7 at its free end. The stuffing box 6 is inserted above the cleanout head and is locked in respect of translation to the cleanout head 7 by means of the pin 8 (FIG. 3). The length of coiled tubing inserted in this way into the stripper depends on the distance between the most distant part of the well which is to be cleaned out and the position (L) of the landing nipple 12 forming a sliding bearing for the maintenance tubing and the hydraulic separation. The length of the tubular extension 5 is equal to or greater than the above distance.

The coiled tubing is suspended in the jaws of a blowout preventer (B.O.P.), and the lock chamber is opened. This conventional equipment for the coiled tubing technique is not illustrated in the drawings and will not be described in detail.

The coiled tubing is cut at the surface, safety being ensured by the position of the ejectable stopper 7a in the cleanout head 7, preventing any flow-back of fluid through the coiled tubing forming the maintenance tubing.

Figure 5:
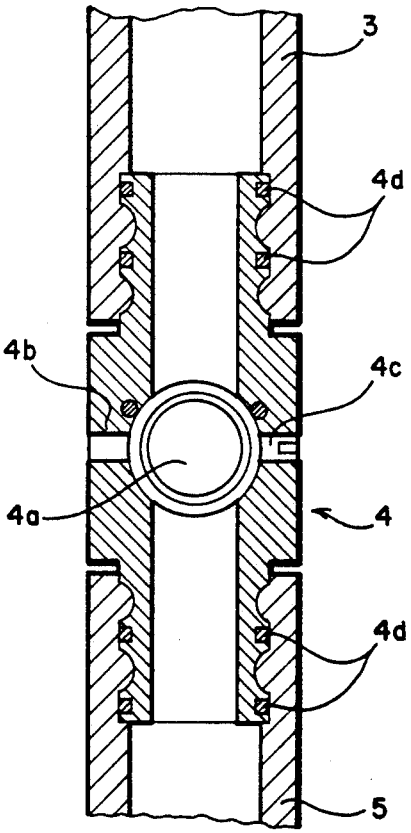
FIG. 5 shows an exemplary embodiment of the obturator connector used for withdrawing the hydroejector after the cleanout operation.

In a manner known per se the hydroejector 3 is inserted with the aid of an obturator connector 4 shown in FIG. 5 of the drawings. This connector 4 comprises a quarter-turn valve 4a housed in a bore 4b and adapted to be oriented by means of a pin 4c. This type of connector also comprises a plurality of seals 4d and an outer surface having a curvilinear profile into the indentations of which the tubular parts of the members to be connected are crushed by force (FIG. 5).

The lock chamber is reconnected, the jaws of the blow-out preventer are opened, and the lowering of the coiled tubing, joined to the hydroejector 3 by means of the connector 2—likewise of 38 mm (1½ inch), is continued so as to form the tubular part designated 1 in FIGS. 1 and 2 of the drawings.

When the stuffing box 6 reaches the level of the hydraulic separation position L, and is thus engaged in the well bottom landing nipple 12, pumping of the working liquid into the annular space between the production tubing 10 and the maintenance tubing 1, 2, 3, 4, 5, 6, and 7 can start; the pressure of the working liquid enables the stuffing box 6 to bear perfectly against the seat 12a of the landing nipple 12 and to be locked thereon in respect of translation. Hydraulic separation is achieved, and the part of the production tubing situated below the hydraulic separation (designated LB) and, consequently, also the well bottom are isolated from the annular space under elevated pressure (LH) situated above the hydraulic separation.

This hydraulic separation constitutes an important feature of the present invention. This separation in fact permits the movement and the evacuation of the sediment without elevated pressure being exerted on the stratum and without contact between the working fluid and the wall of the well. Cleanout operations are effected while the part of the well which is to be cleaned out is isolated by the hydraulic separation achieved through the locking of the stuffing box 6 on the landing nipple 12 at the location L.

It will also be noted that neither the application of the method itself nor the creation of this separation requires the addition of extra equipment or the modification of existing equipment in the completion.

By means of elevated pressure in the maintenance tubing the ejectable stopper 7a is ejected (shearing of the pin 13 or any other means known per se) and falls to the bottom of the cleanout head 7, and the well bottom is then connected to the surface (see FIG. 4).

The working fluid pumped from the surface brings into action the suction of the hydroejector 3 by way of the cleanout head 7 and the tubular extension 5.

Further lowering of the coiled tubing then shears the pin 8 securing the stuffing box 6 on the cleanout head 7. The coiled tubing can then be progressively pushed to bring the cleaning head 7 close to the parts of the well which are to be cleaned out, the extension tube 5 sliding for this purpose in the inside bore 6a of the stuffing box 6.

The sediment is sucked through the apertures 19 in the cleanout head, and rise through the extension tube 5, the connector 4, the hydroejector 3 and the tubing 1 to the surface.

The cleanout head 7 may be a rotary head having a cyclone action through the arrangement of the apertures in helical lines, as already mentioned.

A plurality of passes may be made by maintaining the elevated pressure on the stuffing box 6 against the seat 12a of the landing nipple 12.

At the end of the cleanout operation the working fluid is replaced by a fluid which is non-polluting for the tank and which may or may not have a stabilising action on the well. If this fluid is a gas, the well will generate a head pressure. In this case the maintenance tubing is closed internally when it arrives at the surface by means of an obturator 4a housed in the connector 4 placed under the hydroejector 3, thus permitting the retraction of the hydroejector and the rejoining of the coiled tubing in order to continue the extraction of the latter under continuous pressure.

Finally, an additional advantage of the method according to the invention will be noted, namely the fact that any leakage defect at the stuffing box will not jeopardise the cleanout method, but will simply result in reduced energy efficiency, which can be made good by increasing the flow of working liquid.

I claim:

1. A method of cleaning out a vertical, deviated or horizontal underground well equipped with production tubing, comprising the steps of:

lowering maintenance tubing into an interior of said production tubing;

carrying with said maintenance tubing, means including a cleanout head and a hydroejector for extracting sediment by suction through the maintenance tubing, said cleanout head being carried at an end of said maintenance tubing;

effecting a hydraulic separation in an annular space between the maintenance tubing and the production tubing at a certain level above a part of the well which is to be cleaned out;

injecting into said annular space a working fluid for operation of the hydroejector, said working fluid pressurizing said annular space and said hydraulic separation isolating the pressurized annular space from the well bottom, said well bottom being under reduced pressure; and moving the cleanout head by sliding the maintenance tubing through the hydraulic separation in the part of the well which is to be cleaned out.

2. A method of cleaning out an underground well as claimed in claim 1, wherein said step of effecting a hydraulic separation comprises the step of effecting the hydraulic separation by means of a stuffing box mounted for sliding on a tubular part of the maintenance tubing, said stuffing box cooperating sealingly and by the matching of shapes with a landing nipple on the production tubing at the hydraulic separation.

3. A method of cleaning out an underground well as claimed in claim 1, further comprising the step of forming the maintenance tubing from "coiled" tubing having a diameter smaller than or equal to 38 mm.

4. A method of cleaning out an underground well as claimed in claim 3, wherein said step of effecting said hydraulic separation by means of a stuffing box comprises the steps of providing a stuffing box shaped to bear against the landing nipple;

locking said stuffing box on said landing nipple with respect to relative translation between the landing nipple and stuffing box;

and applying outside seals against an inside surface of said landing nipple so as to effect a leak tight hydraulic separation.

5. Cleanout apparatus for cleaning out a vertical, deviated or horizontal underground well equipped with production tubing, comprising means including maintenance tubing for lowering into an interior of said production tubing, said maintenance tubing carrying means including a cleanout head for extraction of sediment by suction, said cleanout head being carried at an end of a tubular extension of said maintenance tubing;

means for injecting a working fluid for operation of a hydroejector into an annular space between the maintenance tubing and the production tubing at a certain level above the part of the well which is to be cleaned out, thereby pressurizing said annular space;

means for effecting a hydraulic separation in the annular space, said hydraulic separation isolating the pressurized annular space from the well bottom, said well bottom thereby being under reduced pressure; and means for moving said cleanout head in the part of the well which is to be cleaned out by sliding the maintenance tubing through the hydraulic separation.

6. Apparatus as claimed in claim 5, wherein said means for effecting the hydraulic separation comprises a stuffing box mounted for sliding on said tubular extension above said cleanout head; and said hydroejector which is mounted at a second end of said extension, the outlet of the hydroejector being connected to an above ground surface by said maintenance tubing, said maintenance tubing comprising "coiled" tubing.

7. Apparatus as claimed in claim 6, further comprising a landing nipple arranged to cooperate with said stuffing box to effect said hydraulic seal, said landing nipple being positioned on the production tubing, and wherein said cleanout head has an outside diameter smaller than an inside passage diameter of the landing nipple.

8. Apparatus as claimed in claim 7, wherein said stuffing box has an outside diameter larger than an inside passage diameter of the landing nipple, said stuffing box abutting against the landing nipple.

9. Apparatus as claimed in claim 6, wherein the stuffing box is provisionally locked with respect to translation on said tubular extension by means of a pin arranged to be broken by elevated hydraulic pressure on a top face of said stuffing box.

10. Apparatus as claimed in claim 5, wherein said hydroejector has a reduced outside diameter of between 50 and 63 mm and includes means comprising an integrated non-return valve for preventing return of liquid to the annular space between the production tubing and the maintenance tubing.

11. Apparatus as claimed in claim 5, wherein the cleanout head comprises means including an ejectable stopper for closing fluid admission to the maintenance tubing, said stopper being arranged to be ejected as a result of elevated pressure in said maintenance tubing.

12. Apparatus as claimed in claim 5, wherein said cleanout head is a rotary head having a cyclone action.

13. A method of cleaning out a vertical, deviated or horizontal underground well equipped with production tubing, said method being carried out with the aid of a coiled tubing installation comprising coiled tubing wound on a drum, a lock chamber, and a blow-out preventor, and said method comprising the steps of:

inserting the coiled tubing, together with a stuffing box and a cleanout head located at an end of said coiled tubing, into the packer or stripper of the coiled tubing, said stuffing box being provisionally fastened to the cleanout head with respect to translation;

lowering the coiled tubing into the production tubing;

suspending the coiled tubing in the blow-out preventor;

opening the lock chamber;

cutting the coiled tubing at a distance at least equal to a distance between a hydraulic separation and the furthest part of the well which is to be cleaned out, said hydraulic separation being effected in an annular space between the maintenance tubing and the production tubing at a certain level above the part of the well which is to be cleaned out;

inserting a hydroejector with the aid of connectors;

closing the lock chamber;

opening jaws of the blow-out preventor;

continuing lowering of the coiled tubing until the stuffing box is engaged in a landing nipple fastened to the production tubing;

opening communication between the cleanout head and the coiled tubing connection in order to suck the sediment to the surface;

injecting working fluid into the annular space between the production tubing and the coiled tubing in order to start up the hydroejector; and continuing to lower the cleanout head after it has been disconnected from the stuffing box.

* * * * *